US011373820B1

(12) United States Patent
Sun et al.

(10) Patent No.: US 11,373,820 B1
(45) Date of Patent: Jun. 28, 2022

(54) KEY STRUCTURE AND SCISSORS-TYPE CONNECTING ELEMENT THEREOF

(71) Applicant: Primax Electronics Ltd., Taipei (TW)

(72) Inventors: Shau-Cheng Sun, Taipei (TW); Tsu-Yi Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/334,369

(22) Filed: May 28, 2021

(30) Foreign Application Priority Data

Mar. 15, 2021 (TW) ..... 110109051

(51) Int. Cl.
*H01H 13/14* (2006.01)
*H01H 3/12* (2006.01)

(52) U.S. Cl.
CPC ..... *H01H 13/14* (2013.01); *H01H 3/125* (2013.01)

(58) Field of Classification Search
CPC .... H01H 13/14; H01H 3/125; H01H 13/7065; H01H 3/122; H01H 13/70; H01H 3/12; H01H 13/705; H01H 2233/07
USPC ..... 200/341, 344, 345
See application file for complete search history.

(56) References Cited

U.S. PATENT DOCUMENTS 10,325,735 B2 * 6/2019 Yen ..... H01H 3/125
10,636,592 B2 * 4/2020 Wang ..... H01H 13/10
11,152,168 B1 * 10/2021 Wu ..... H01H 13/7065

* cited by examiner

*Primary Examiner* — Lheiren Mae A Caroc
(74) *Attorney, Agent, or Firm* — Kirton McConkie; Evan R. Wltt

(57) ABSTRACT

A key structure includes a keycap, a base plate, a first scissors-type connecting element, a second scissors-type connecting element and a coupling plate. The first scissors-type connecting element and the second scissors-type connecting element are arranged between the keycap and the base plate. The first scissors-type connecting element is upwardly assembled with the keycap and downwardly assembled with the base plate. The first scissors-type connecting element includes a first inner frame and a first outer frame. The second scissors-type connecting element is upwardly assembled with the keycap and downwardly assembled with the base plate. The second scissors-type connecting element includes a second inner frame and a second outer frame. The coupling plate is arranged between the first outer frame and the second outer frame. The coupling plate is detachably assembled with the first outer frame and the second outer frame.

9 Claims, 4 Drawing Sheets

KEY STRUCTURE AND SCISSORS-TYPE CONNECTING ELEMENT THEREOF

FIELD OF THE INVENTION

The present invention relates to a key structure, and more particularly to a multiple key structure with a reinforced coupling plate.

BACKGROUND OF THE INVENTION

Generally, a keyboard device comprises plural keys. In addition to the ordinary keys, the plural keys comprise some keys with special appearance (e.g., multiple keys). Since the length of the multiple key is much larger than its width, some drawbacks occur. For example, while the multiple key is pressed down by the user, the multiple key is readily tilted and even jammed. For solving this problem, a metallic connecting rod is installed on a base plate of the key structure or an inner side of a keycap of the key structure in order to stabilize and reinforce the key structure. However, the metallic connecting rod occupies an additional inner space of the key structure, and the metallic connecting rod readily collides with the base plate or the keycap to generate noise.

In other words, the conventional key structure needs to be further improved.

SUMMARY OF THE INVENTION

For solving the drawbacks of the conventional technologies, the present invention provides a key structure. The key structure includes a keycap, a base plate, two scissors-type connecting elements and a reinforced coupling plate. The reinforced coupling plate is arranged between the two scissors-type connecting elements. The arrangement of the coupling plate can increase the structural strength and the equilibrium of the scissors-type connecting elements while increasing the stability of the keycap during the upward/downward moving process. In addition, no additional collision or noise is generated.

In accordance with an aspect of the present invention, a key structure is provided. The key structure includes a keycap, a base plate, a first scissors-type connecting element, a second scissors-type connecting element and a coupling plate. The first scissors-type connecting element is arranged between the keycap and the base plate. The first scissors-type connecting element is upwardly assembled with the keycap and downwardly assembled with the base plate. The first scissors-type connecting element includes a first inner frame and a first outer frame. The second scissors-type connecting element is arranged between the keycap and the base plate. The second scissors-type connecting element is upwardly assembled with the keycap and downwardly assembled with the base plate. The second scissors-type connecting element includes a second inner frame and a second outer frame. The coupling plate is arranged between the first outer frame and the second outer frame. The coupling plate is detachably assembled with the first outer frame and the second outer frame.

In an embodiment, the coupling plate is assembled with the first outer frame and the second outer frame in a sliding manner.

In an embodiment, the first outer frame includes a first slide track, the second outer frame includes a second slide track, and the coupling plate includes a first guiding groove and a second guiding groove. The first guiding groove and the second guiding groove are opposed to each other with respect to the coupling plate. The first guiding groove is assembled with the first slide track. The second guiding groove is assembled with the second slide track.

In an embodiment, the first outer frame includes a first lateral part and a second lateral part, and the second outer frame includes a third lateral part and a fourth lateral part. The first lateral part and the second lateral part are opposed to each other with respect to the first outer frame. The third lateral part and the fourth lateral part are opposed to each other with respect to the second outer frame. The first lateral part is farther from the second scissors-type connecting element than the second lateral part. The third lateral part is closer to the first scissors-type connecting element than the fourth lateral part. The first outer frame further includes a first slide track on the second lateral part. The second outer frame further includes a second slide track on the third lateral part.

In an embodiment, the coupling plate includes a first guiding groove and a second guiding groove. the first guiding groove and the second guiding groove are opposed to each other with respect to the coupling plate. The first guiding groove is assembled with the first slide track. The second guiding groove is assembled with the second slide track.

In an embodiment, the first outer frame further includes a third slide track on the first lateral part, and the second outer frame further includes a fourth slide track on the fourth lateral part.

In an embodiment, the key structure further includes an elastic element. The elastic element is arranged between the keycap and the base plate along a vertical direction. The elastic element is arranged between the first scissors-type connecting element and the second scissors-type connecting element along a horizontal direction.

In an embodiment, the coupling plate of the key structure has an opening. The elastic element is accommodated within the opening. The elastic element is contacted with the keycap.

In an embodiment, the key structure further includes a membrane switch between the elastic element and the base plate. When the elastic element is subjected to a deformation, the membrane switch is triggered by the elastic element.

In accordance with another aspect of the present invention, a scissors-type connecting element is provided. The scissors-type connecting element is arranged between a keycap and a base plate. The scissors-type connecting element includes an inner frame and an outer frame. The outer frame is arranged around the inner frame, and assembled with the inner frame. The outer frame includes a first lateral part and a second lateral part. The first lateral part and the second lateral part are opposed to each other with respect to the outer frame. The outer frame further includes a first slide track on the first lateral part and a second slide track on the second lateral part.

In an embodiment, the outer frame has a fixed end and a slidable end. The fixed end and the slidable end are opposed to each other with respect to the outer frame. The fixed end is connected with the first lateral part and the second lateral part. The slidable end is connected with the first lateral part and the second lateral part.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1A:
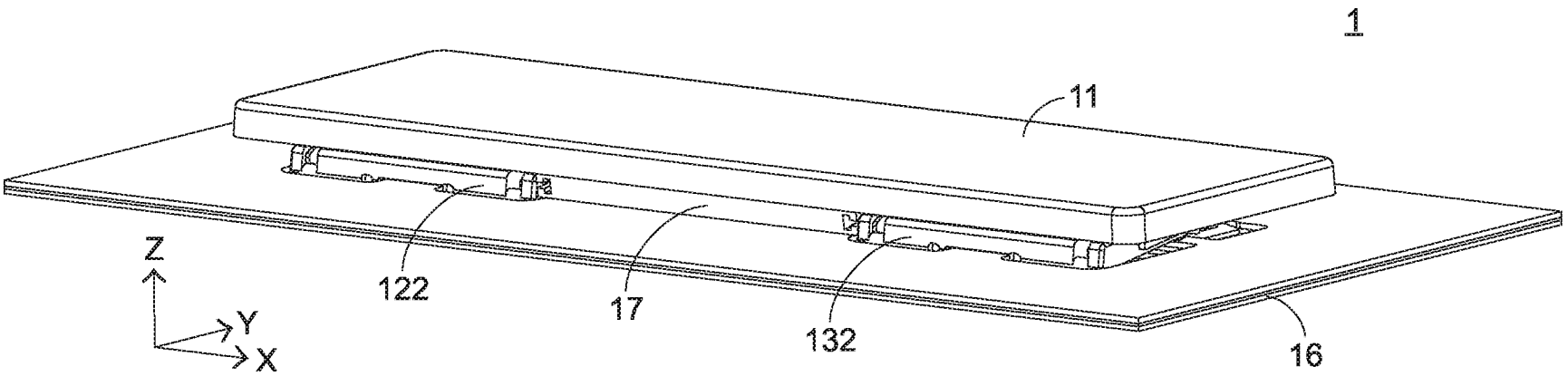
FIG. 1A is a schematic perspective view illustrating a key structure according to an embodiment of the present invention.
Figure 1B:
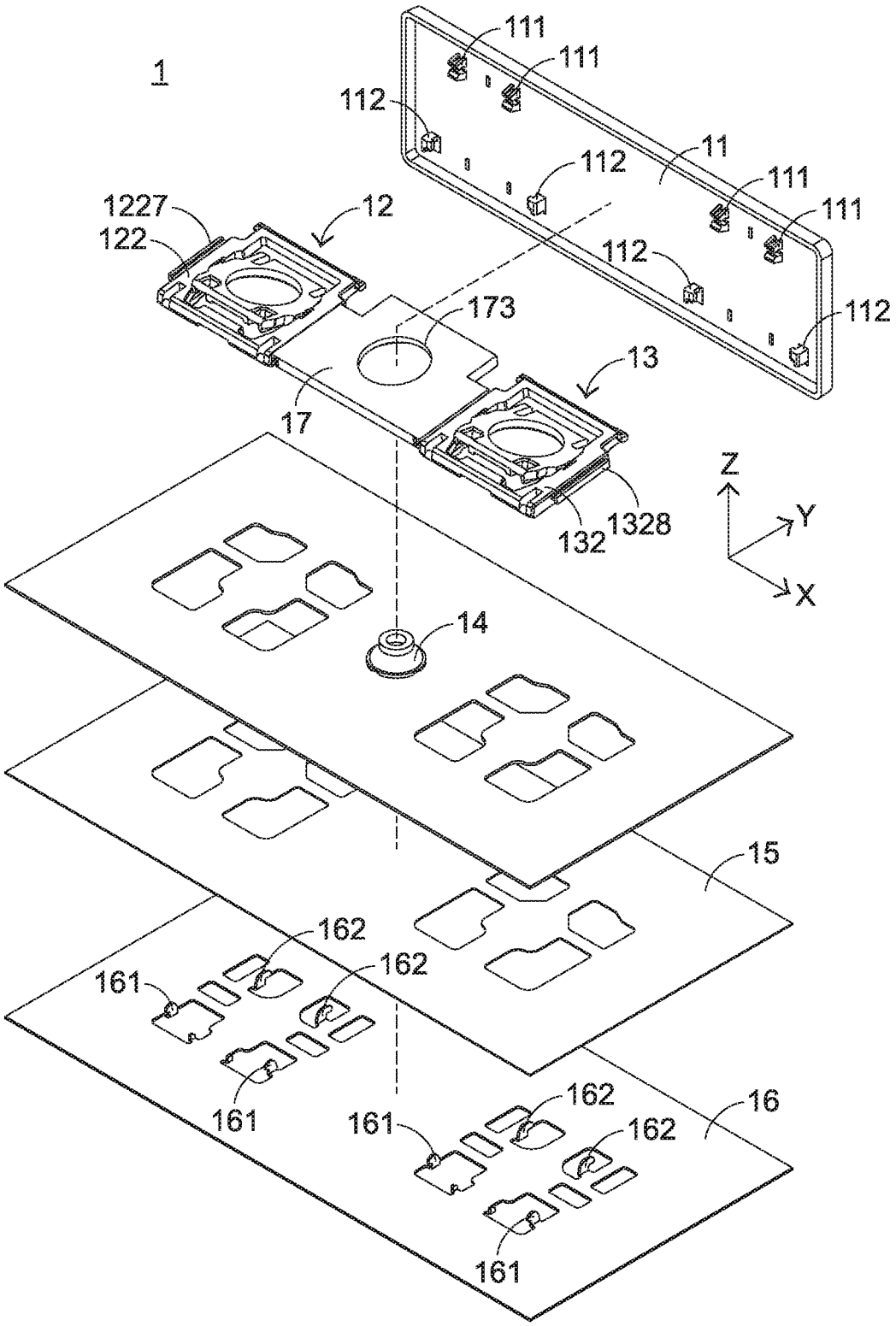
FIG. 1B is a schematic exploded view illustrating the key structure as shown in FIG. 1A.

Please refer to FIGS. 1A and 1B. FIG. 1A is a schematic perspective view illustrating a key structure according to an embodiment of the present invention. FIG. 1B is a schematic exploded view illustrating the key structure as shown in FIG. 1A. The key structure 1 comprises a keycap 11, a first scissors-type connecting element 12, a second scissors-type connecting element 13, an elastic element 14, a membrane switch 15 and a base plate 16.

According to the structural design, the key structure 1 of this embodiment can applied to a specified key structure such as a multiple key structure. In the multiple key structure, the length of the keycap is larger than the width of the keycap. Consequently, the first scissors-type connecting element 12 and the second scissors-type connecting element 13 are arranged along a horizontal direction (i.e., in the direction parallel to the X axis). The elastic element 14 is arranged between the first scissors-type connecting element 12 and the second scissors-type connecting element 13. Particularly, the elastic element 14 is located at a middle region of the key structure 1 and arranged between the first scissors-type connecting element 12 and the second scissors-type connecting element 13. Consequently, while the keycap 11 is pressed down, the elastic element 14 can be successfully subjected to deformation to trigger the underlying membrane switch 15 even if the pressed position is not at the center of the keycap 11. In this embodiment, the first scissors-type connecting element 12, the elastic element 14 and the second scissors-type connecting element 13 are arranged along the horizontal direction (i.e., in the direction parallel to the X axis). That is, the first scissors-type connecting element 12, the elastic element 14 and the second scissors-type connecting element 13 are not overlapped along the vertical direction (i.e., in the direction parallel to the Z axis).

The first scissors-type connecting element 12 and the second scissors-type connecting element 13 are arranged between the keycap 11 and the base plate 16. The first scissors-type connecting element 12 and the second scissors-type connecting element 13 are upwardly assembled with the keycap 11 and downwardly assembled with the base plate 16. The first scissors-type connecting element 12 comprises a first inner frame 121 and a first outer frame 122. The first outer frame 122 is arranged around the first inner frame 121. After the first inner frame 121 and the first outer frame 122 are assembled with each other, the first inner frame 121 and the first outer frame 122 are rotatable relative to each other in the rotating manner similar to the scissors' rotation. For example, a middle region of the outer side of the first inner frame 121 is equipped with a pivotal shaft, and a middle region of the inner side of the first outer frame 122 is equipped with a corresponding pivotal hole or a corresponding receiving recess. After the pivotal shaft is inserted into the pivotal hole or the receiving recess, the first inner frame 121 and the first outer frame 122 are rotatable relative to each other. It is noted that the rotation mechanism may be altered or modified. For example, in another embodiment, the first inner frame 121 is equipped with the pivotal hole or the receiving recess, and the first outer frame 122 is equipped with the pivotal shaft. Alternatively, the first inner frame 121 and the first outer frame 122 have corresponding engaging structures (e.g., convex structures and concave structures). The second scissors-type connecting element 13 comprises a second inner frame 131 and a second outer frame 132. The second inner frame 131 and the second outer frame 132 are rotatable relative to each other. The operations of the second inner frame 131 and the second outer frame 132 are similar to the operations of the first inner frame 121 and the first outer frame 122 of the first scissors-type connecting element 12. Similarly, the rotation mechanism of the second scissors-type connecting element 13 may be altered or modified.

The first inner frame 121 of the first scissors-type connecting element 12 has a fixed end 1211 and a slidable end 1212. The first inner frame 121 comprises a pivotal shaft 1213 at the fixed end 1211 and a slidable shaft 1214 at the slidable end 1212. The first outer frame 122 of the first scissors-type connecting element 12 also has a fixed end 1221 and a slidable end 1222. The first outer frame 122 comprises a pivotal shaft 1223 at the fixed end 1221 and a slidable shaft 1224 at the slidable end 1222. The second inner frame 131 of the second scissors-type connecting element 13 has a fixed end 1311 and a slidable end 1312. The second inner frame 131 comprises a pivotal shaft 1313 at the fixed end 1311 and a slidable shaft 1314 at the slidable end 1312. The second outer frame 132 of the second scissors-type connecting element 13 also has a fixed end 1321 and a slidable end 1322. The second outer frame 132 comprises a pivotal shaft 1323 at the fixed end 1321 and a slidable shaft 1324 at the slidable end 1322.

Moreover, the keycap 11 comprises plural hooks 111 and plural sliding grooves 112, and the base plate 16 comprises plural hooks 161 and 162. When the first scissors-type connecting element 11 and the second scissors-type connecting element 12 are assembled with the keycap 11 and the base plate 16, the pivotal shaft 1213 of the first inner frame 121 and the pivotal shaft 1313 of the second inner frame 131 are pivotally coupled to the corresponding hooks 111 of the keycap 11, the slidable shaft 1214 of the first inner frame 121 and the slidable shaft 1314 of the second inner frame 131 are pivotally coupled to the corresponding hooks 162 of the base plate 16, the pivotal shaft 1223 of the first outer frame 122 and the pivotal shaft 1323 of the second outer frame 132 are pivotally coupled to the corresponding hooks 161 of the base plate 16, and the slidable shaft 1224 of the first outer frame 122 and the slidable shaft 1324 of the second outer frame 132 are inserted into the corresponding sliding grooves 112 of the keycap 11. With the assistance of the first scissors-type connecting element 12 and the second scissors-type connecting element 13, the keycap 11 can be moved upwardly or downwardly relative to the base plate 16 along a specified path.

As mentioned above, the key structure 1 further comprises the elastic element 14. After the key structure 1 is assembled, the elastic element 14 is arranged the keycap 11 and the base plate 16 along the vertical direction (i.e., in the direction parallel to the Z axis), and the elastic element 14 is arranged between the first scissors-type connecting element 12 and the second scissors-type connecting element 13 along the horizontal direction (i.e., in the direction parallel to the X axis). For allowing the elastic element 14 to be contacted with the keycap 11, the coupling plate 17 of the key structure 1 has an opening 173. The elastic element 14 is accommodated within the opening 173. After the elastic element 14 is penetrated upwardly through the opening 173, the elastic element 14 is contacted with the keycap 11. In this embodiment, the elastic element 14 is a combination of a bowl-shaped elastomer and a thin film, wherein the bowl-shaped elastomer is installed on the thin film. Alternatively, in another embodiment, the elastic element is a bowl-shaped elastomer without the thin film.

In the key structure 1 of this embodiment, the membrane switch 15 is arranged between the elastic element 14 and the base plate 16. While the keycap 11 is pressed down, the elastic element 14 is compressed and subjected to deformation. The deformed elastic element 14 is supported by the base plate 16 and compressed to trigger the membrane switch 15 to generate a pressing signal. When the keycap 11 is no longer pressed, the elastic element 14 is restored to its original shape from the deformed state. At the same time, the keycap 11 is upwardly pushed by the elastic element 14, and the keycap 11 is returned to its undepressed position.

In this embodiment, the key structure 1 is equipped with the coupling plate 17 to connect the first scissors-type connecting element 12 with the second scissors-type connecting element 13. Consequently, the force can be transferred from the first scissors-type connecting element 12 to the second scissors-type connecting element 13, or the force can be transferred from the second scissors-type connecting element 13 to the first scissors-type connecting element 12. The arrangement of the coupling plate 17 can increase the structural strength and the equilibrium of the first scissors-type connecting element 12 and the second scissors-type connecting element 13 while increasing the stability of the keycap 11 during the upward/downward moving process.

In the key structure 1 of this embodiment, the coupling plate 17 is in contact with the first outer frame 122 of the first scissors-type connecting element 12 and the second outer frame 132 of the second scissors-type connecting element 13 only. Especially, there is a gap or a distance between the coupling plate 17 and the keycap 11 or the base plate 16. Consequently, while the key structure 1 is pressed down by the user, the coupling plate 17 does not touch the keycap 11 or the base plate 16. In other words, no additional collision or noise is generated.

Figure 2A:
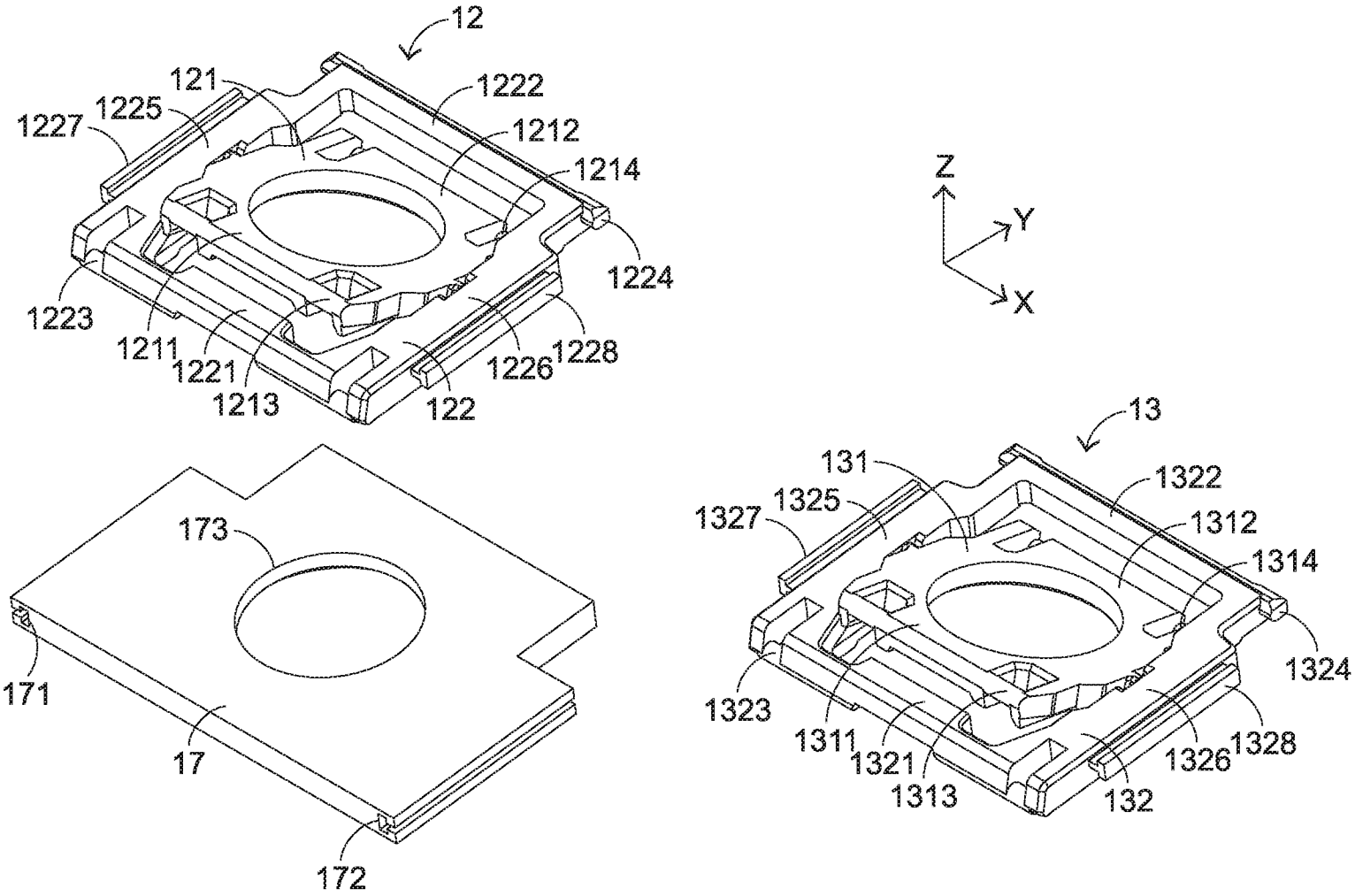
FIG. 2A is a schematic exploded view illustrating the relationship between the first scissors-type connecting element, the second scissors-type connecting element and the coupling plate of the key structure according to the embodiment of the present invention.
Figure 2B:
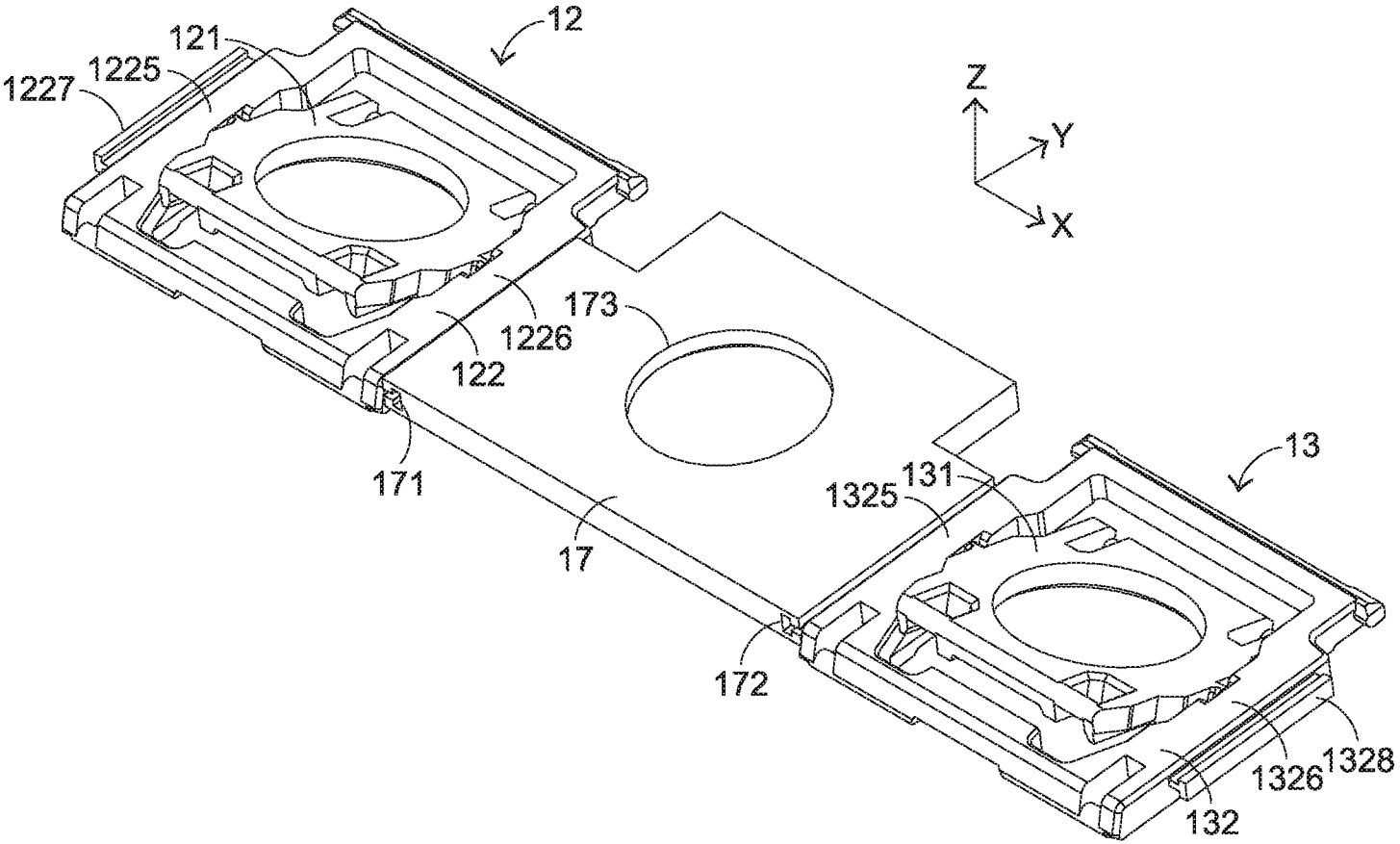
FIG. 2B is a schematic perspective view illustrating the assembled structure of the first scissors-type connecting element, the second scissors-type connecting element and the coupling plate of the key structure according to the embodiment of the present invention.

FIG. 2A is a schematic exploded view illustrating the relationship between the first scissors-type connecting element, the second scissors-type connecting element and the coupling plate of the key structure according to the embodiment of the present invention. FIG. 2B is a schematic perspective view illustrating the assembled structure of the first scissors-type connecting element, the second scissors-type connecting element and the coupling plate of the key structure according to the embodiment of the present invention. Please refer to FIGS. 1B, 2A and 2B. The coupling plate 17 is arranged between the first outer frame 122 and the second outer frame 132. Moreover, the coupling plate 17 is detachably assembled with the first outer frame 122 and the second outer frame 132. Since the coupling plate 17 is detachably assembled with the first outer frame 122 and the second outer frame 132 and these components are not integrally formed as a one-piece structure, it is easy to rework during the assembling process. If one part is damaged, only the damaged part needs to be replaced. Moreover, the material, the weight, the characteristic or the structure of the coupling plate 17 may be adjusted according to the practical requirements. For example, in case that the coupling plate 17 with the proper weight or material is used, the key structure 1 can provide a specified tactile feel. In other words, the selection of the coupling plate 17 is not limited by the material or the structure of the first outer frame 122 or the second outer frame 132.

In an embodiment, the coupling plate 17 is detachably assembled with the first outer frame 122 and the second outer frame 132 through a slidable mechanism. For example, in the key structure 1 of the present invention, the coupling plate 17 is assembled with the first outer frame 122 and the second outer frame 132 in a sliding manner. Consequently, during the assembling process or the disassembling process, the coupling plate 17 can be assembled with or disassembled from the first outer frame 122, or the coupling plate 17 can be assembled with or disassembled from the second outer frame 132.

Please refer to FIG. 2A again. The first outer frame 122 comprises two lateral parts 1225 and 1226 at two opposite sides. The second outer frame 132 comprises two lateral parts 1325 and 1326 at two opposite sides. The lateral part 1225 of the first outer frame 122 is arranged between the fixed end 1211 and the slidable end 1212. In addition, the lateral part 1225 of the first outer frame 122 is arranged far from the second scissors-type connecting element 13. The lateral part 1226 of the first outer frame 122 is also arranged between the fixed end 1211 and the slidable end 1212. In addition, the lateral part 1226 of the first outer frame 122 is arranged close to the second scissors-type connecting element 13. The lateral part 1325 of the second outer frame 132 is arranged between the fixed end 1311 and the slidable end 1312. In addition, the lateral part 1325 of the second outer frame 132 is arranged close to the first scissors-type connecting element 12. The lateral part 1326 of the second outer frame 132 is arranged between the fixed end 1311 and the slidable end 1312. In addition, the lateral part 1326 of the second outer frame 132 is arranged far from the first scissors-type connecting element 12. Moreover, the first outer frame 122 further comprises two slide tracks 1227 and 1228. The slide track 1227 is installed on the lateral part 1225 of the first outer frame 122. The slide track 1228 is installed on the lateral part 1226 of the first outer frame 122. The second outer frame 132 also comprises two slide tracks 1327 and 1328. The slide track 1327 is installed on the lateral part 1325 of the second outer frame 132. The slide track 1328 is installed on the lateral part 1326 of the second outer frame 132.

Moreover, the coupling plate 17 comprises two guiding grooves 171 and 172. The two guiding grooves 171 and 172 are located at two opposite sides of the coupling plate 17. The profiles of the guiding grooves 171 and 172 match the profiles of the slide tracks 1228 and 1327, respectively. As shown in FIG. 2A, the guiding grooves 171 and 172 are T-shaped guiding grooves, and the slide tracks 1228 and 1327 are T-shaped slide tracks. Consequently, the coupling plate 17 can be slid along the Y-axis direction in order to be assembled with the first outer frame 122 and the second outer frame 132 (see FIGS. 2A and 2B). Under this circumstance, the guiding groove 171 is assembled with the slide track 1228, and the guiding groove 172 is assembled with the slide track 1327.

Moreover, the profiles of the slide tracks 1227, 1228, 1327 and 1328 are complementary to the profiles of the guiding grooves 171 and 172. It is noted that the profiles of the sliding tracks and the profiles of the guiding grooves are not restricted to the T-shaped profiles. For example, in some other embodiments, the sliding tracks and the profiles of the guiding grooves have trapezoidal profiles, triangular profiles or any other appropriate geometric profiles. It is noted that numerous modifications and alterations may be made while retaining the teachings of the invention. For example, in another embodiment, the first outer frame and the second outer frame are equipped with guiding grooves, and the coupling plate is equipped with the corresponding sliding tracks. Under this circumstance, the purpose of assembling the associated components in the sliding manner can be also achieved.

As mentioned above, the coupling plate 17 is assembled with the first outer frame 122 and the second outer frame 132 in the sliding manner. In other words, the assembling process can be implemented as long as the associated components are moved along a linear direction. This assembling process that only requires the linear motion is intuitive and easy. Moreover, since the two lateral parts 1225 and 1226 of the first outer frame 122 are equipped with the slide tracks 1227 and 1228 and the two lateral parts 1325 and 1326 of the second outer frame 132 are equipped with the slide tracks 1327 and 1328, another benefit is provided. For example, when the coupling plate 17 is assembled with the first scissors-type connecting element 12 and the second scissors-type connecting element 13, the positions of the first scissors-type connecting element 12 and the second scissors-type connecting element 13 can be exchanged. Consequently, the assembling complexity is reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a keycap;

a base plate;

a first scissors connecting element arranged between the keycap and the base plate, wherein the first scissors connecting element is upwardly assembled with the keycap and downwardly assembled with the base plate, and the first scissors connecting element comprises a first inner frame and a first outer frame;

a second scissors connecting element arranged between the keycap and the base plate, wherein the second scissors connecting element is upwardly assembled with the keycap and downwardly assembled with the base plate, and the second scissors connecting element comprises a second inner frame and a second outer frame; and a coupling plate arranged between the first outer frame and the second outer frame, wherein the coupling plate is detachably assembled with the first outer frame and the second outer frame.

2. The key structure according to claim 1, wherein the coupling plate is assembled with the first outer frame and the second outer frame in a sliding manner.

3. The key structure according to claim 1, wherein the first outer frame comprises a first slide track, the second outer frame comprises a second slide track, and the coupling plate comprises a first guiding groove and a second guiding groove, wherein the first guiding groove and the second guiding groove are opposed to each other with respect to the coupling plate, the first guiding groove is assembled with the first slide track, and the second guiding groove is assembled with the second slide track.

4. The key structure according to claim 1, wherein the first outer frame comprises a first lateral part and a second lateral part, and the second outer frame comprises a third lateral part and a fourth lateral part, wherein the first lateral part and the second lateral part are opposed to each other with respect to the first outer frame, the third lateral part and the fourth lateral part are opposed to each other with respect to the second outer frame, the first lateral part is farther from the second scissors connecting element than the second lateral part, and the third lateral part is closer to the first scissors connecting element than the fourth lateral part, wherein the first outer frame further comprises a first slide track on the second lateral part, and the second outer frame further comprises a second slide track on the third lateral part.

5. The key structure according to claim 4, wherein the coupling plate comprises a first guiding groove and a second guiding groove, wherein the first guiding groove and the second guiding groove are opposed to each other with respect to the coupling plate, the first guiding groove is assembled with the first slide track, and the second guiding groove is assembled with the second slide track.

6. The key structure according to claim 4, wherein the first outer frame further comprises a third slide track on the first lateral part, and the second outer frame further comprises a fourth slide track on the fourth lateral part.

7. The key structure according to claim 1, wherein the key structure further comprises an elastic element, wherein the elastic element is arranged between the keycap and the base plate along a vertical direction, and the elastic element is arranged between the first scissors connecting element and the second scissors connecting element along a horizontal direction.

8. The key structure according to claim 7, wherein the coupling plate of the key structure has an opening, wherein the elastic element is accommodated within the opening, and the elastic element is contacted with the keycap.

9. The key structure according to claim 7, wherein the key structure further comprises a membrane switch between the elastic element and the base plate, wherein when the elastic element is subjected to a deformation, the membrane switch is triggered by the elastic element.

* * * * *